US006396034B2

(12) United States Patent
Drozd et al.

(10) Patent No.: US 6,396,034 B2
(45) Date of Patent: May 28, 2002

(54) METHOD AND APPARATUS FOR ELECTROMAGNETIC EXPOSURE OF PLANAR OR OTHER MATERIALS

(75) Inventors: J. Michael Drozd; William T. Joines, both of Durham, NC (US)

(73) Assignee: Industrial Microwave Systems, Inc., Morrisville, NC (US)

( * ) Notice: Subject to any disclaimer, the term of this patent is extended or adjusted under 35 U.S.C. 154(b) by 0 days.

(21) Appl. No.: 09/832,831

(22) Filed: Apr. 12, 2001

Related U.S. Application Data

(62) Division of application No. 09/372,749, filed on Aug. 11, 1999, now Pat. No. 6,246,037.

(51) Int. Cl.[7] ..... H05B 6/70; H05B 6/78

(52) U.S. Cl. ..... 219/693; 219/695; 219/746; 219/750; 219/700

(58) Field of Search ..... 219/693, 692, 219/691, 695, 696, 699, 700, 701, 745, 746, 748, 750, 762; 333/227, 230, 239, 249

(56) References Cited

U.S. PATENT DOCUMENTS

| | | | | |
|---|---|---|---|---|
| 2,467,230 A | | 4/1949 | Revercomb et al. | |
| 2,549,511 A | | 4/1951 | Nelson | |
| 2,650,291 A | | 8/1953 | Kinn | |
| 3,471,672 A | | 10/1969 | White | |
| 3,474,209 A | | 10/1969 | Parker | |
| 3,491,457 A | * | 1/1970 | Schreiber et al. | 219/692 |
| 3,622,732 A | | 11/1971 | Williams | |
| 3,622,733 A | | 11/1971 | Smith | |
| 3,632,945 A | | 1/1972 | Johnson | |
| 3,666,905 A | | 5/1972 | Muller et al. | |
| 3,761,665 A | | 9/1973 | Nagao et al. | |
| 3,765,425 A | | 10/1973 | Stungis et al. | |
| 3,765,985 A | * | 10/1973 | Siard et al. | 219/699 |
| 3,843,861 A | | 10/1974 | Van Amsterdam | |
| 3,851,132 A | | 11/1974 | Van Koughnett | |
| 4,108,147 A | | 8/1978 | Kantor | |
| 4,160,144 A | | 7/1979 | Kashyap et al. | |
| 4,234,775 A | | 11/1980 | Wolfberg et al. | |
| 4,401,873 A | | 8/1983 | Berggren et al. | |
| 4,446,348 A | | 5/1984 | Huang et al. | |
| 4,476,363 A | | 10/1984 | Berggren et al. | |
| RE32,664 E | | 5/1988 | Osepchuk et al. | |
| 4,760,230 A | | 7/1988 | Hässler | |
| 4,859,821 A | * | 8/1989 | Meyer et al. | 219/693 |
| 4,999,469 A | | 3/1991 | Dudley et al. | |
| 5,107,602 A | | 4/1992 | Lööf | |
| 5,169,571 A | | 12/1992 | Buckley | |
| 5,278,375 A | | 1/1994 | Berteaud et al. | |
| 5,369,250 A | | 11/1994 | Meredith | |
| 5,402,672 A | | 4/1995 | Bradford | |
| 5,457,303 A | | 10/1995 | Shute et al. | |
| 5,536,921 A | | 7/1996 | Hedrick et al. | |
| 5,798,395 A | | 8/1998 | Lauf et al. | |
| 5,804,801 A | | 9/1998 | Lauf et al. | |
| 5,879,756 A | | 3/1999 | Fathi et al. | |
| 5,958,275 A | | 9/1999 | Joines et al. | |

FOREIGN PATENT DOCUMENTS

| | | | | |
|---|---|---|---|---|
| JP | 1-274381 | * | 11/1989 | 219/693 |
| JP | 2-223186 | | 9/1990 | |
| WO | WO 98/49870 | * | 11/1998 | |

* cited by examiner

*Primary Examiner*—Philip H. Leung
(74) *Attorney, Agent, or Firm*—Burns, Doane, Swecker & Mathis, L.L.P.

(57) ABSTRACT

A path for a material passes through an opening and along a segment through an off-peak region of an electric field. An E-plane bend delivers an electromagnetic wave to the segment. A standing wave is used to heat the material. The peaks or valleys are pushed or pulled by a movable surface or by changing the frequency of the electromagnetic wave. A rectangular choke flange is used at the opening to the segment. A curved segment connects the segment to another segment for heating the material. According to another aspect of the invention, a segment is used to heat just the edge of a planar material.

23 Claims, 9 Drawing Sheets

FIG. 1
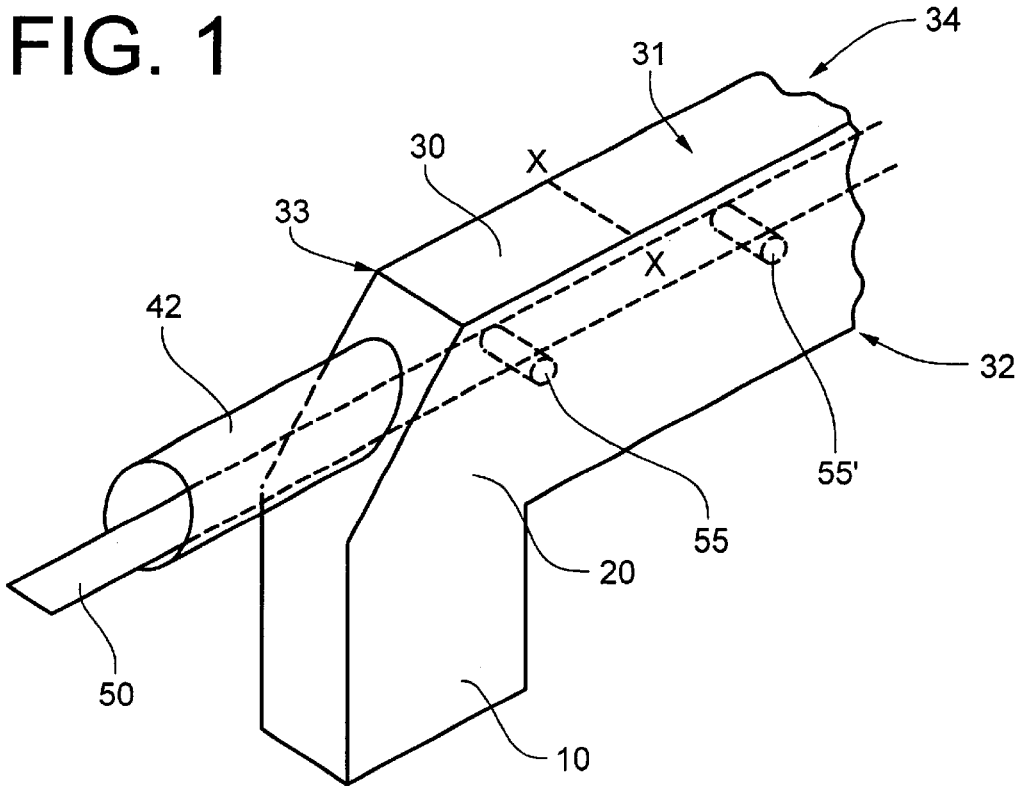
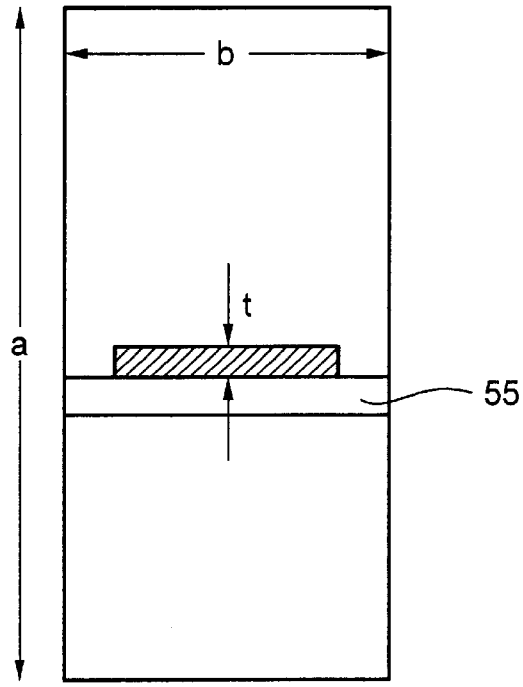
FIG. 2

METHOD AND APPARATUS FOR ELECTROMAGNETIC EXPOSURE OF PLANAR OR OTHER MATERIALS

This application is a divisional of application Ser. No. 09/372,749, filed on Aug. 11, 1999, now U.S. Pat. No 6,246,037.

BACKGROUND

The invention relates to electromagnetic energy, and more particularly, to electromagnetic exposure of planar materials.

One drawback with conventional waveguides is that the microwave signal attenuates as it moves away from its source. This attenuation versus propagation distance increases when lossy planar materials are introduced into the waveguide. As a result, a material fed into the waveguide through a slot is heated more at one end of a segment (closer to a source ) than at the other end (farther from a source). Prior art structures have not made use of the slot's orientation as a means for addressing this problem. In a traditional slotted waveguide, there is a field peak midway between two conducting surfaces. In the prior art, the slot is at this midway point. See, for example, U.S. Pat. Nos. 3,471,672, 3,765,425, and 5,169,571.

One way to address this drawback is disclosed in our co-pending and co-assigned application Ser. No. 08/848,244, now U.S. Pat. No. 5,958,275. Another way to address this drawback is disclosed in our co-pending and co-assigned application Ser. No. 09/350,991. In our two earlier applications, which are incorporated herein by reference, a path has a first conductive surface and a second conductive surface and a first end and a second end. A source is capable of generating an electromagnetic wave that propagates in a direction from the first end to the second end. The path has a slot that extends in a direction from the first end to the second end. The planar material is passed through the slot in a direction perpendicular to the propagation of the electromagnetic wave.

The structure disclosed in our two earlier applications is extremely useful for heating wider materials. In some applications, it may be advantageous to heat the material by passing the material in a direction parallel to the propagation of the electromagnetic wave. One possible way to heat a material by passing a material in a direction parallel to the propagation of the electromagnetic wave is disclosed in Metaxas et al, "Industrial Microwave Heating," Peregrinus on behalf of the Institution of Electrical Engineers, London, United Kingdom, 1983 (hereinafter, referred to as "Metaxas").

Referring now to FIG. 1, Metaxas discloses that a microwave power input provides an electromagnetic wave (not shown) to a $TE_{10}$ waveguide 30. The waveguide 30 has a mitre bend 20 and rod supports 55. A conveyor belt 50 passes through a choke 42 along a path that is halfway between the top conductive surface 31 and the bottom conductive surface 32. FIG. 2 further illustrates that "[t]he conveyor belt is supported at intervals so that the mid-depth plane of the workload is coincident with the mid-points of the broad faces of the waveguide[.]" Id. at 114.

Mitre bend 20 is usually referred to as a H-plane bend. In a H-plane bend, the long side a in FIG. 2 remains in the same plane. In an E-plane bend, the short side b in FIG. 2 remains in the same plane. In FIG. 1, the H-plane bend is oriented so that the electric field travels through the conveyor belt 50.

There are at least six drawbacks with the wave applicator disclosed in Metaxas's book. The first drawback is that the microwave signal attenuates as it moves away from the microwave power input 10. This attenuation versus propagation distance increases when lossy planar materials are introduced into the waveguide. As a result, a material fed into the waveguide 30 is heated more at the end of the waveguide closer to the input (end 33) than at the other end (end 34).

A second drawback is that the electric field is disrupted when the electric field travels through conveyor belt 50. In addition, there is better coupling if the electric field sees a narrow dimension, as opposed to a wide dimension, of conveyor belt 50. Metaxas fails to recognize that there is better coupling and the conveyor belt 50 is heated more uniformly if the electromagnetic wave travels across, as opposed to through, conveyor belt 50.

A third drawback is that a traveling wave is used to heat the planar material. Metaxas specifies on page 114 that. "[i]n some cases where the workload has a very high loss factor, the traveling wave applicator is terminated in a short circuit because there is only negligible residual power." Metaxas fails to recognize that it is possible to use a standing wave and continuously change the length or effective length of the waveguide or the frequency of the standing wave so as to even out the hot spots of the standing wave.

A fourth drawback is that the circular choke flange 42 is too wide at its widest point. Metaxas fails to recognize that a rectangular choke flange can limit the amount of energy that is lost through the opening.

A fifth drawback is that Metaxas does not disclose how to pass a planar material along more than one straight section of a serpentine waveguide. Metaxas specifies that "[a]t each end a mitre bend (usually 90°E-plane) permits connection to the generator and terminating load. The mitre plates of the bends have holes with cutoff waveguide chokes to permit the belt and workload to enter and leave the applicator." Id. at 115. While Metaxas describes in the next section, meander (or serpentine) traveling wave applicators, Metaxas makes it clear that the material travels perpendicular to the long sections of the waveguide. Metaxas fails to recognize that it is possible to pass a material along (as opposed to across) multiple straight sections of a serpentine waveguide.

A sixth drawback is that in Metaxas it is not possible to heat just the edge of the planar material. In FIGS. 1 and 2, the entire conveyor belt 50 passes through the waveguide 30. In some applications, it is either not necessary or it is detrimental to heat the entire planar material. There is a need for a device that can heat just the edge of a planar material.

SUMMARY

The present invention overcomes many of the problems associated with electromagnetic exposure of planar materials. According to one aspect of the invention, a path for a material passes through an opening and along a segment through an off-peak region of an electric field.

According to another aspect of the invention, an E-plane bend delivers an electromagnetic wave to the segment.

According to another aspect of the invention, a standing wave is used to heat the material. The peaks or valleys are pushed or pulled by a movable surface or by changing the frequency of the electromagnetic wave.

According to another aspect of the invention, a rectangular choke flange is used at the opening to the segment.

According to another aspect of the invention, a curved segment connects the segment to another segment for heating the material.

According to another aspect of the invention, a segment is used to heat just the edge of a planar material.

An advantage of the invention is that it is possible to uniformly heat the material at different points along the segment. Another advantage is that it is possible to improve coupling and decrease disruption of the electric field. Another advantage is that a standing wave is more efficient than a traveling wave, the energy loss associated with traveling waves is avoided. Another advantage is that it is possible to decrease the amount of electromagnetic energy that escapes through the opening. Another advantage is that it is possible to provide extended heating despite space constraints. Another advantage is that is possible to heat just the edge of a material.

BRIEF DESCRIPTION OF THE DRAWINGS

The foregoing, and other objects, features, and advantages of the invention will be more readily understood upon reading the following detailed description in conjunction with the drawings in which:

FIG. 1 is an illustration of a traveling wave applicator;

FIG. 2 is a cross-section of FIG. 1;

DETAILED DESCRIPTION

In the following description, specific details are discussed in order to provide a better understanding of the invention. However, it will be apparent to those skilled in the art that the invention can be practiced in other embodiments that depart from these specific details. In other instances, detailed descriptions of well-known methods and circuits are omitted so as to not obscure the description of the invention with unnecessary detail.

Figure 3:
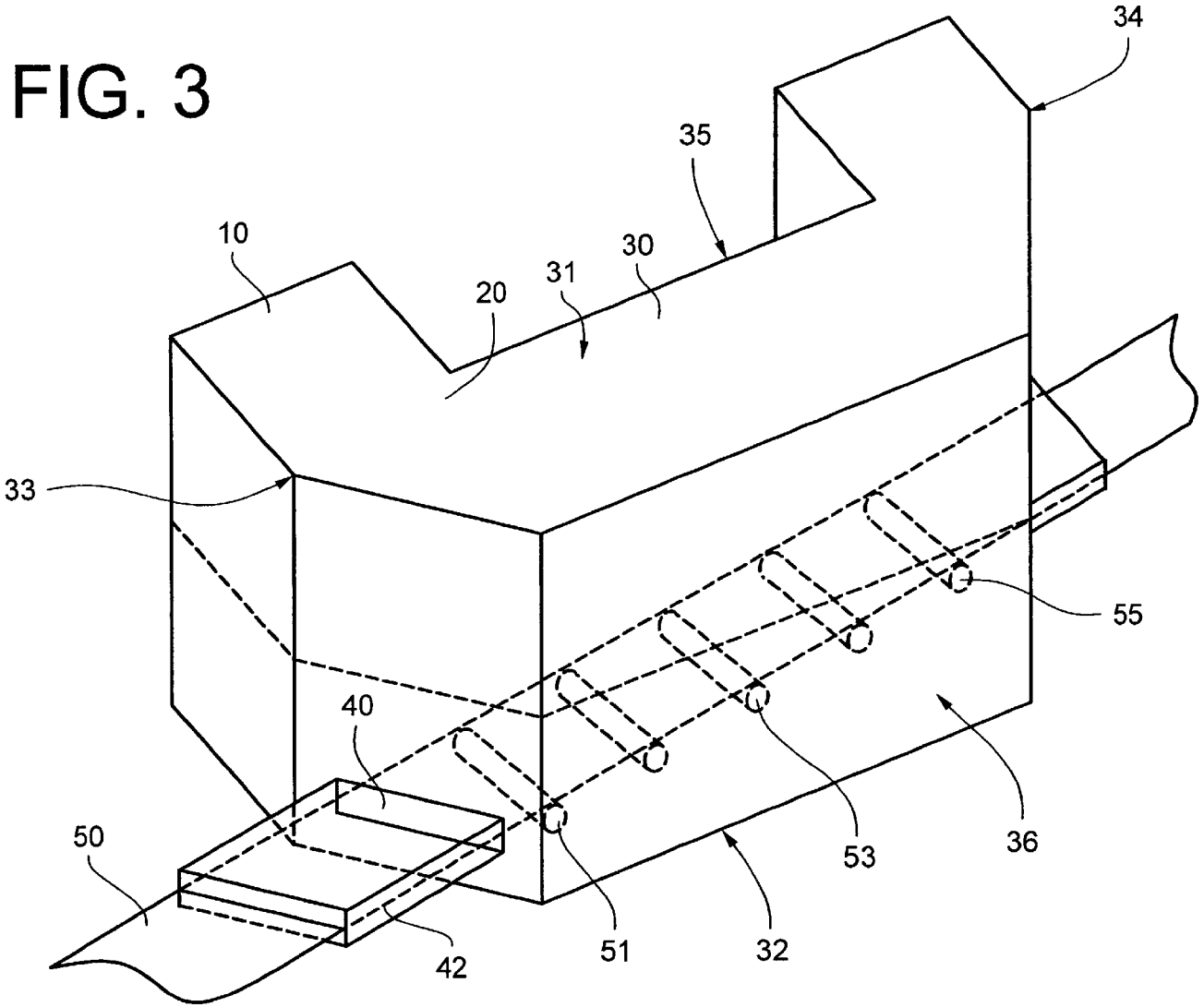
FIG. 3 is an illustration of a device for heating planar or other materials.

Referring now to the drawings, FIG. 1 is an illustration of a traveling wave applicator and FIG. 2 is a cross-section of FIG. 1. FIG. 3 is an illustration of a device for heating planar or other materials. Segment 30 has a first conductive surface 31 and a second conductive surface 32. Segment 30 has a first end 33 and a second end 34.

A curved segment 20 connects microwave power input 10 with segment 30. Microwave power input 10 provides an electromagnetic wave that propagates in a direction from the first end 33 to the second end 34. The electromagnetic wave creates an electric field between the first conductive surface 31 and the second conductive surface 32.

Segment 30 has an opening 40 at the first end 33. The opening 40 creates a path 50 for a material. The path 50 can be a conveyor belt for planar materials such as semiconductor wafers, a tube for liquid or gel-like materials, a roll of paper or textiles, or any other means of passing the material through opening 40 and along segment 30.

In FIG. 3, segment 30 is a rectangular waveguide. Sides 35 and 36 are longer than sides 31 and 32. As a result, it is possible to keep the electromagnetic wave in $TE_{10}$ mode. If the electromagnetic wave is in $TE_{10}$ mode, the electric field has a peak that is halfway between the top surface 31 and the bottom surface 32. If supports 51 and 53 are positioned near the bottom surface 32 and support 55 is positioned near a point halfway between the top surface 31 and the bottom surface 32, it is possible to create a path 50 that passes through opening 40 and along segment 30 from the first end 33 to the second end 34 through a region that is an off-peak region of the electric field.

If the material is relatively lossy, the angle of the path 50 should be increased. If the material is relatively un-lossy, the angle of the path 50 should be decreased. If segment 30 is built for heating a particular material with a particular degree of lossiness, it is not necessary to adjust the angle of path 50. If exposure segment 30 is built for heating different materials with different degrees of lossiness, it may be advantageous to adjust the angle or effective angle of path 50.

If the curved segment 20 is oriented like the H-plane bend in FIG. 1, the electric field is disrupted when the electric field travels through conveyor belt 50. There is better coupling if the electric field sees a narrow dimension, as opposed to a wide dimension, of conveyor belt 50. To overcome this problem, a E-plane bend should be used to connect input 10 to segment 30. It will be appreciated by those skilled in the art that a mitre bend can cause losses. A curved segment can be used instead of a mitre bend to decrease the amount of loss.

A choke flange 42 should be used to limit the amount of electromagnetic energy that escapes through opening 40. The opening 40 needs to be large enough to allow the planar material to pass through opening 40. As the size of the opening 40 increases, the amount of electromagnetic energy that can escape through opening 40 tends to increase. Therefore, in order to minimize leakage, the optimum size of opening 40 will depend on the size of the planar material. A circular opening like the one in FIG. 1 is too wide at the center point above path 50. A rectangular opening decreases the width at the center point above path 50, and therefore, decreases the amount of electromagnetic energy that can escape.

Figure 4A:
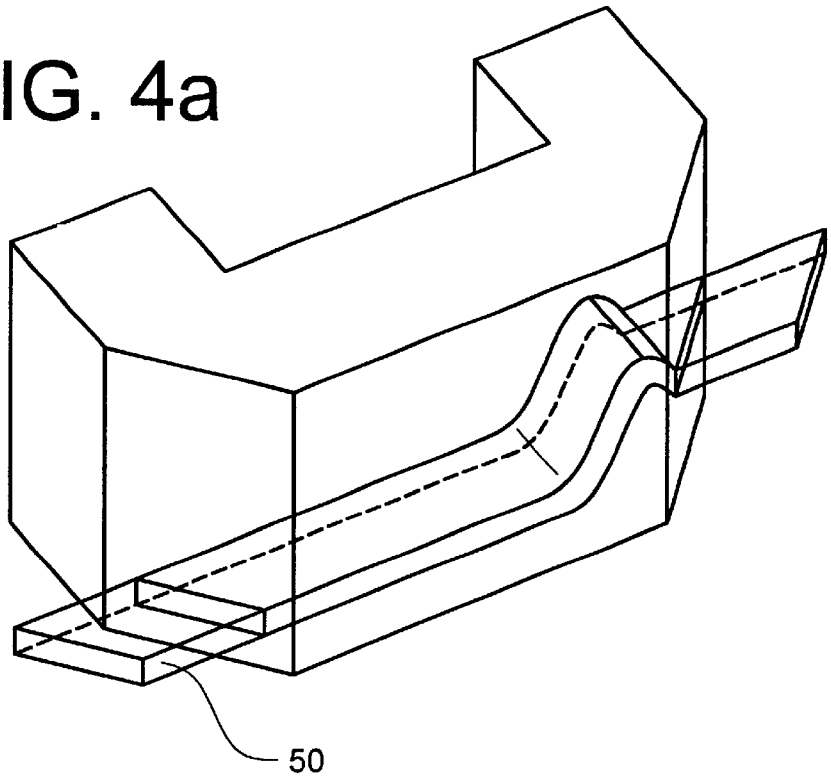
FIGS. 4*a* and 4*b* are illustrations of devices for heating planar or other materials.
Figure 4B:
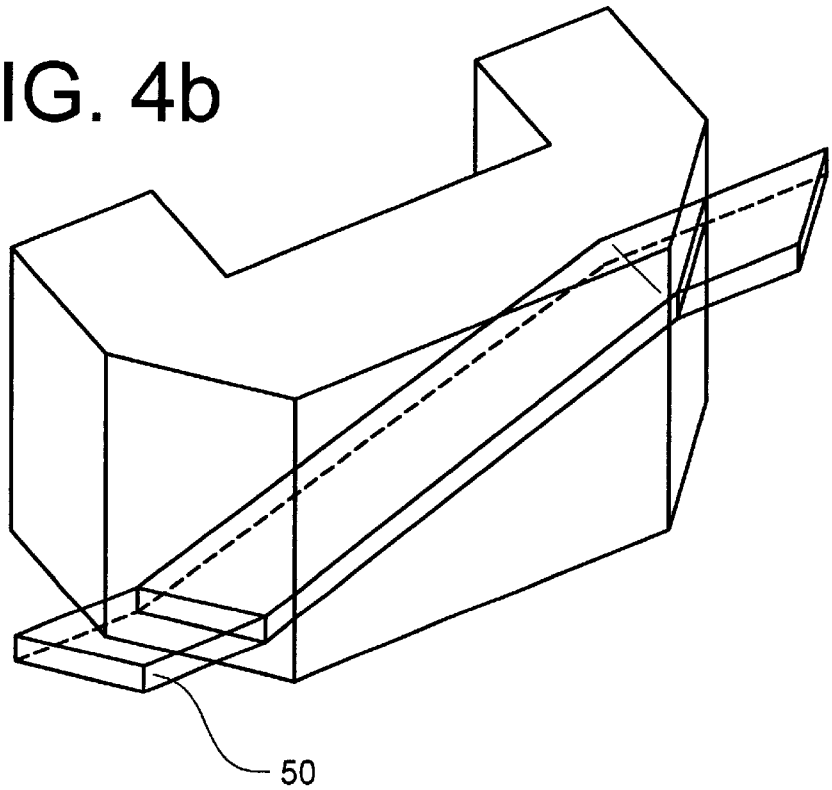

FIGS. 4*a* and 4*b* are illustrations of devices for heating planar or other materials. In both figures, the path 50 passes through a more off-peak region to a less off-peak region to a more off-peak region. It will be appreciated by those skilled in the art that in some applications it is advantageous to gradually increase the heating and then gradually decrease the heating. These variations in heating can be achieved by varying the slope and direction of path 50. In FIG. 4*a*, path 50 has a curved shape. In FIG. 4*b*, path 50 has a straight shape that passes through the peak of the electromagnetic field.

Figure 5A:
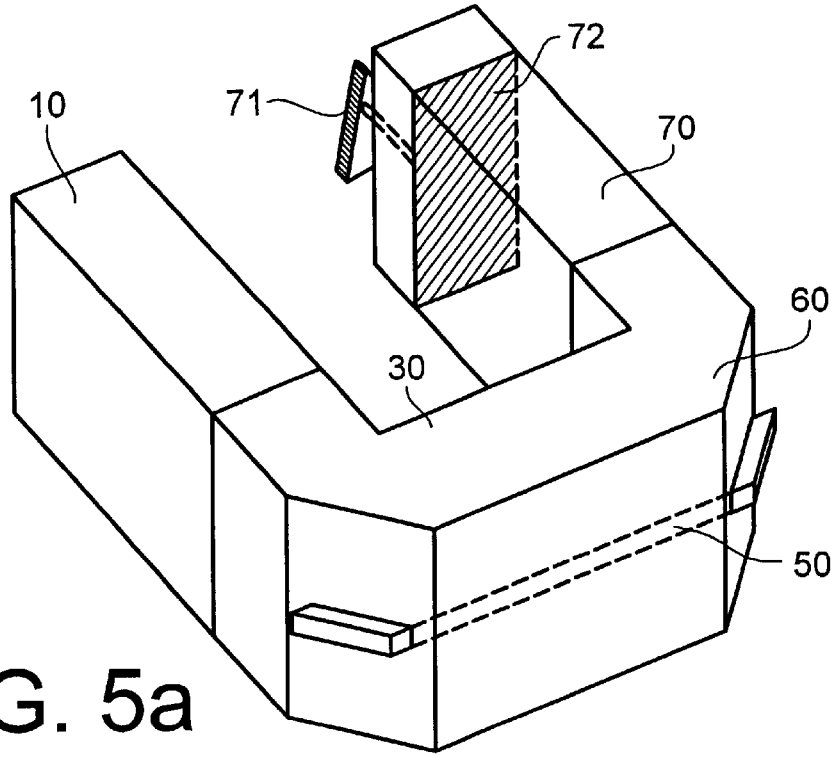
FIGS. 5*a* and 5*b* are illustrations of devices for heating planar or other materials.
Figure 5B:
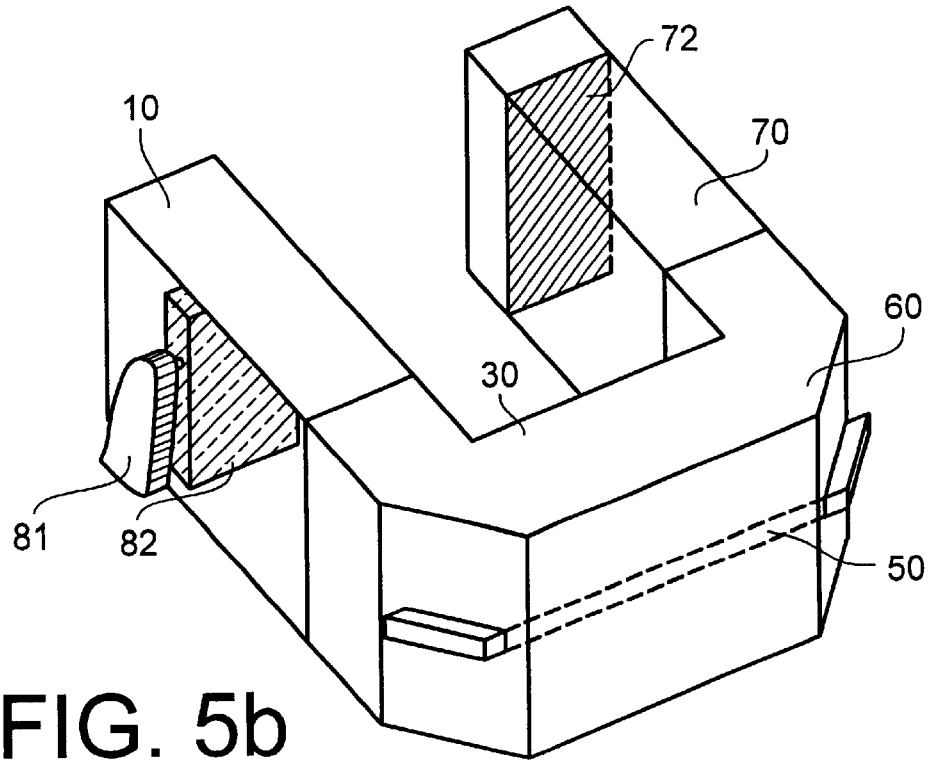

FIGS. 5*a* and 5*b* are illustrations of a device for heating planar or other materials. In both figures, segment 30 and segment 70 are connected by a curved segment 60. Segment 70 terminates at point 72. The electromagnetic wave in segments 30, 60, and 70 has peaks and valleys. If point 72 is a short circuit, the electromagnetic wave is a standing wave and the locations of the peaks and the valleys are stationary. If the peaks and valleys are stationary, the peaks and valleys tend to create hot spots and cold spots along segment 30. This is why conventional applicators tend to use a traveling wave.

It will be appreciated by those skilled in the art that the location of the peaks and valleys is a function of the combined length of segments 30, 60, and 70. If the combined length of segments 30, 60, and 70 changes, so does the location of the peaks and valleys. It is possible to use a standing wave and continuously change the combined length (or effective length) of segments 30, 60, and 70 to simulate a traveling wave. There are several ways to continuously change the combined length of segments 30, 60, and 70.

FIG. 5*a* illustrates a motor 71 that is attached to a movable plate 72. As plate 72 slides either towards segment 60 or away from segment 60, the peaks and valleys of the standing wave are pushed and pulled along segments 30, 60, and 70. If plate 72 is moved back and forth at a rate significantly faster than the rate at which the planar material 40 moves along segment 30, it is possible to effectively smooth the hot spots in segment 30 without having to use a traveling wave.

FIG. 5*b* illustrates a motor 81 that is attached to a dielectric structure 82. As dielectric structure 82 turns, the peaks and valleys are "pushed" or "pulled" along segments 30, 60, and 70. If structure 82 is rotated at a rate significantly faster than the rate at which the planar material moves along segment 30, it is possible to effectively smooth the hot spots in segment 30.

Another way to "push" or "pull" the peaks and valleys is to sweep the frequency at the power input 10. The source can adjust the range of frequencies and the rate at which the frequencies are swept. If the wave is a traveling wave, the sweeping can be used to increase or decrease the rate at which the peaks and valleys propagate along the path. If the wave is a standing wave, the sweeping can be used to move the peaks and valleys so as to prevent the formation of hot and cold spots along the path. If the source sweeps a large range of frequencies, it may be more advantageous to use a short and a standing wave. If the source sweeps a small range of frequencies to merely prevent arcing, it may be more advantageous to use a matched load and a traveling wave.

If the source is a swept frequency source, benefits of a diagonal path can still be realized, particularly if the frequency sweep is such that the electromagnetic wave is maintained in the lowest order mode ($TE_{10}$). This may be accomplished by sweeping the frequency somewhere between the range of no less than $f_c$ and slightly less than $2f_c$ where $f_c$ is the cutoff frequency of the path, that is, the lowest frequency that will propagate in the path. Although the diagonal path may still provide benefits at frequencies greater than $2f_c$, the greatest benefits occur if operation is maintained in the $TE_{10}$ mode.

Figure 6A:
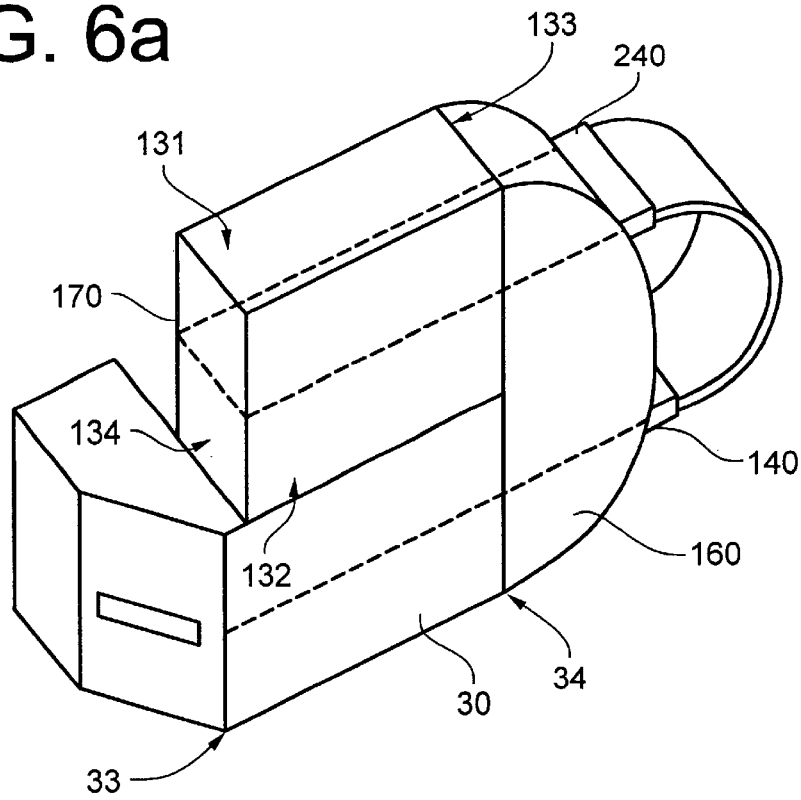
FIGS. 6*a* and 6*b* are illustrations of devices for heating planar or other materials.
Figure 6B:
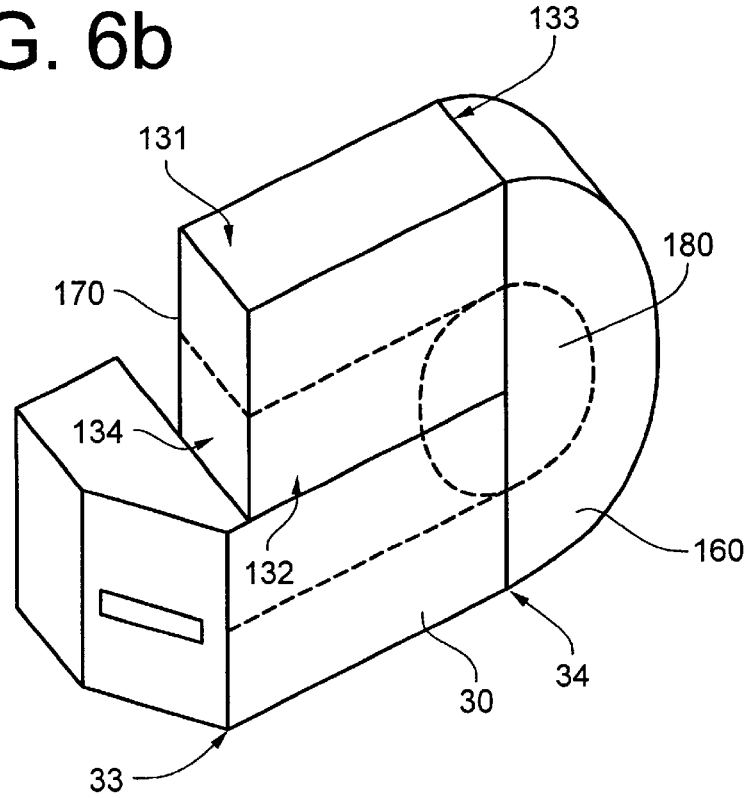

FIGS. 6*a* and 6*b* are illustrations of devices for heating planar or other materials. Both devices comprise a second segment 170 that has a first conductive surface 131, a second conductive surface 132, a first end 133, and a second end 134. A curved segment 160 connects end 34 to end 133. The path for the material passes through the first segment 30 from end 33 to end 34 and through the second segment 170 from end 133 to end 134.

In FIG. 6*a,* segment 30 has an opening 140 at end 34. Segment 170 has an opening 240 at end 133. The path exits opening 140 and enters opening 240. The structure shown allows the material to be treated or cooled before being heated in segment 170.

In FIG. 6*b,* the path passes through the first segment from end 33 to end 34, through the curved segment 160, and through the second segment 170 from the end 133 to end 134. The path passes around a roller 180 as it passes through the curved segment 160. The structure shown allows the material to be continuously heated. In either device, the path can follow a curved or straight shape so as to pass through a region that is off-peak.

Figure 7:
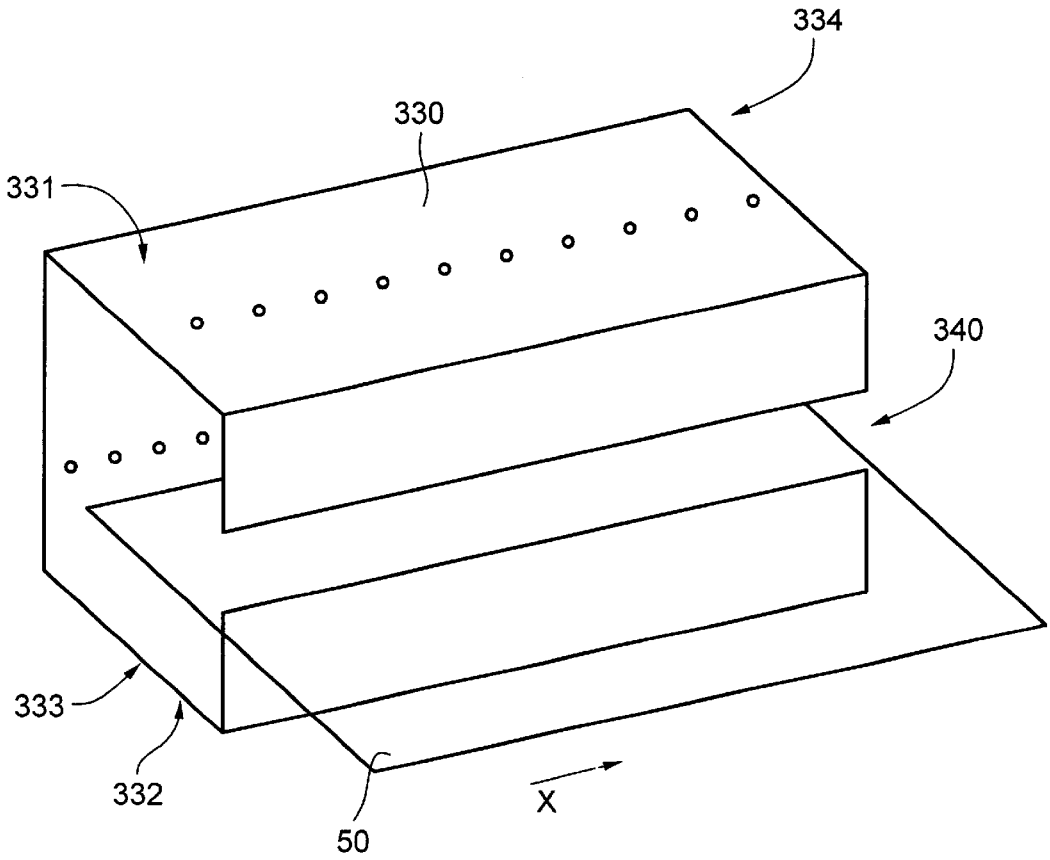
FIG. 7 is an illustration of a device for heating the edge of a planar material.

FIG. 7 is an illustration of a device for heating the edge of a planar material. Segment 330 has a first conductive surface 331, a second conductive surface 332, a first end 333, and a second 334. Segment 330 has an opening 340 for an edge of material 50.

A source generates an electromagnetic wave that propagates in a direction from the first end 333 to the second end 334 (direction x). The electromagnetic wave creates an electric field between surfaces 331 and 332. A motor pushes or pulls material 50 so that the edge of material 50 passes from the first end 333 of segment 330 to the second end 334 of segment 330 inside segment 330 and the middle of material 50 passes from the first end 333 of segment 330 to the second end 334 of segment 330 outside segment 330. Segment 330 has small openings for to facilitate vapor removal and/or pressurized air.

Figure 8:
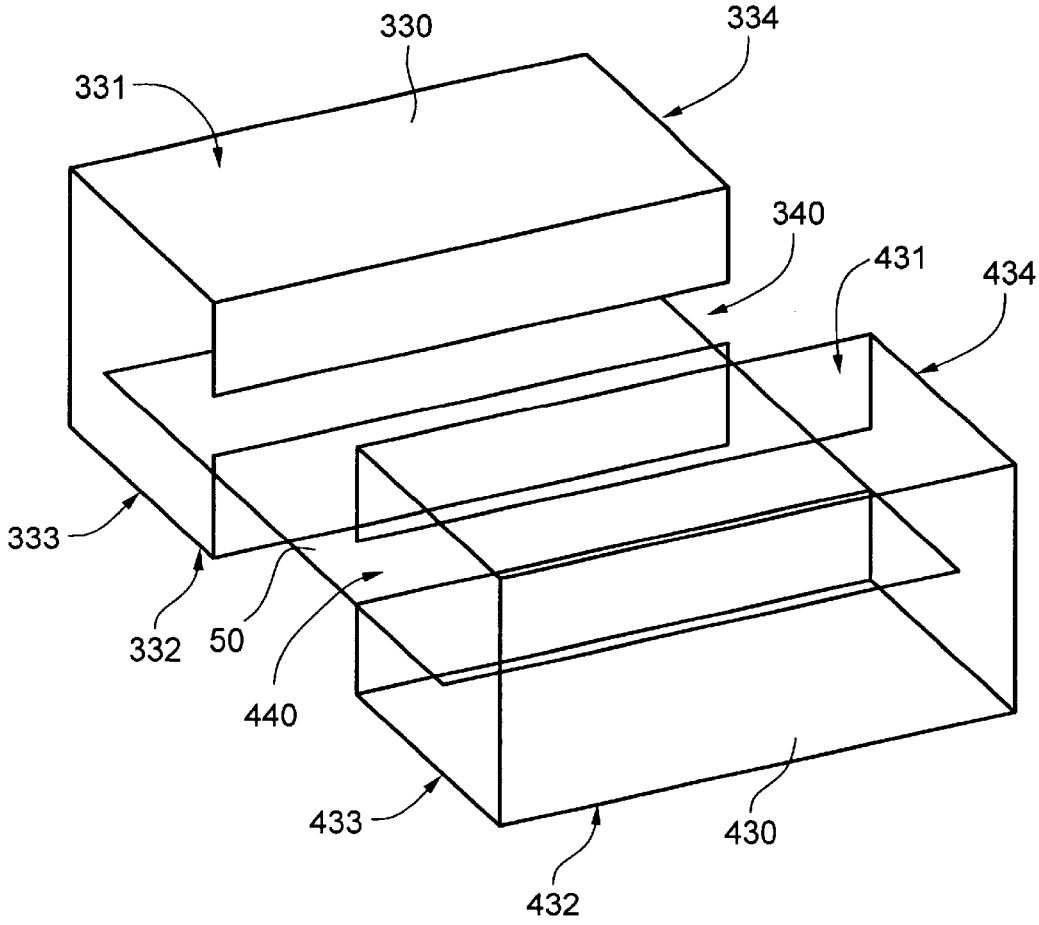
FIG. 8 is an illustration of a device for heating two edges of a planar material.

FIG. 8 is an illustration of a device for heating two edges of a planar material. A second segment 430 has a first conductive surface 431, a second conductive surface 432, a first end 433, and a second end 434. The second segment 430 has an opening 440 for a second edge of material 50.

A motor or any other means pushes or pulls material 50 so that the first edge of material 50 passes from the first end 333 of the first segment 330 to the second end 334 of the first segment 330 inside the first segment 330, the second edge of the material passes from the first end 433 of the second segment 430 to the second end 434 of the second segment 430 inside the second segment 430, and the middle of material 50 passes from the first end of both segments to the second end of both segments outside both segments.

Figure 9:
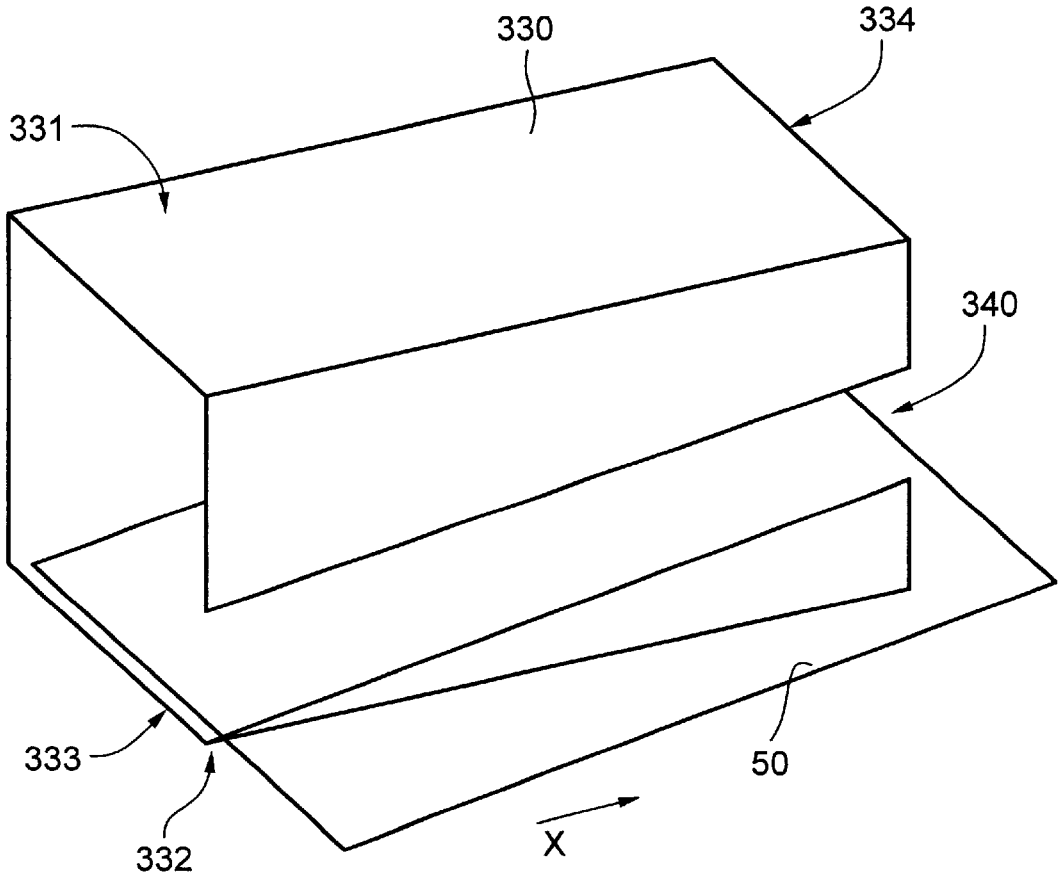
FIG. 9 is an illustration of a device for heating the edge of a planar material.

FIG. 9 is an illustration of a device for heating the edge of a planar material. Segment 330 has an opening 340 that is more off-peak at the first end 333 than at the second end 334. If the material is relatively lossy, the angle of the opening 134 should be increased. If the material is relatively un-lossy, the angle of opening 134 should be decreased. If segment 330 is built for heating a particular material with a particular degree of lossiness, it is not necessary to adjust the angle of opening 134. If segment 330 is built for heating different materials with different degrees of lossiness, it may be advantageous to adjust the angle or effective angle of opening 134.

Figure 10A:
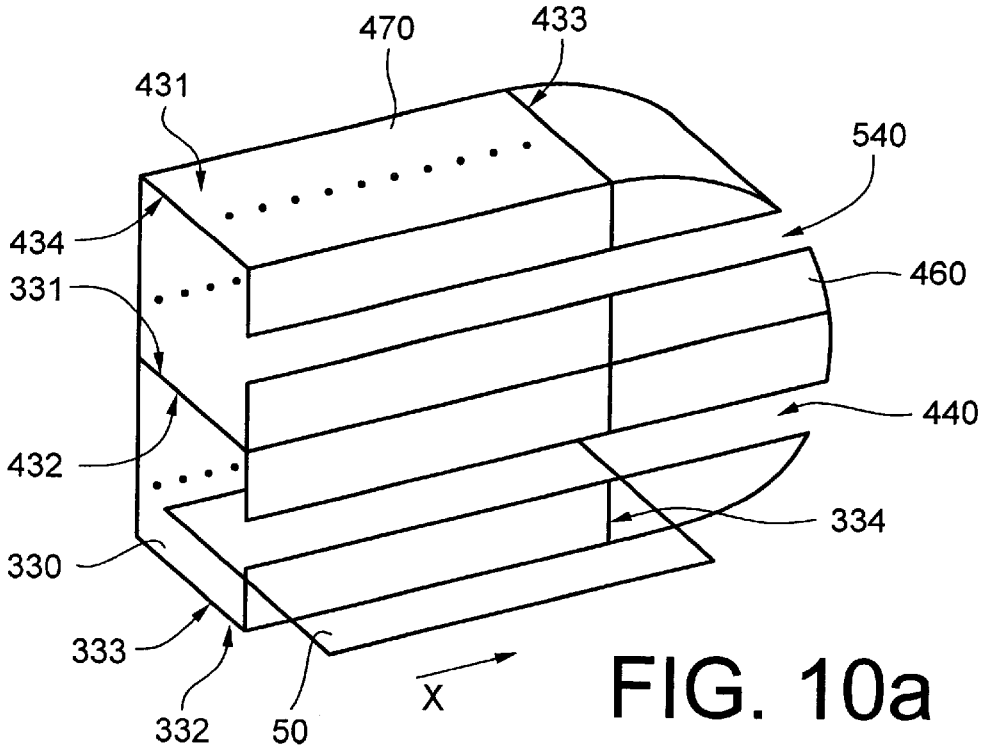
FIGS. 10*a* and 10*b* are illustrations of devices for heating planar or other materials.
Figure 10B:
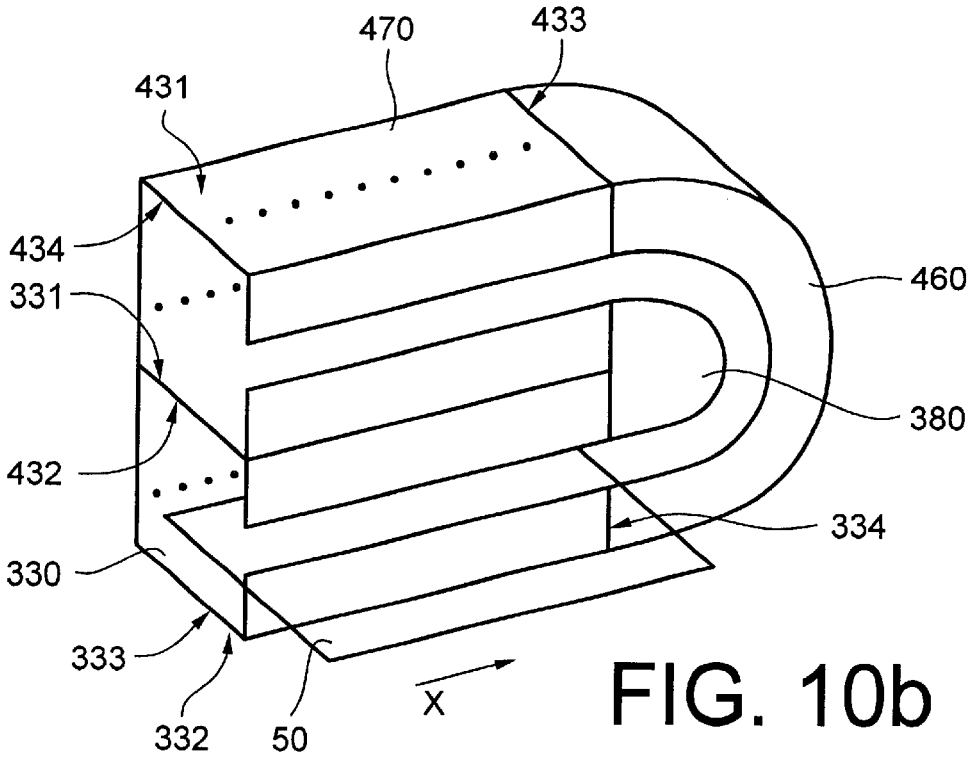

FIGS. 10*a* and 10*b* are illustrations of devices for heating planar or other materials. Both devices comprise a second segment 470 that has a first conductive surface 431, a second conductive surface 432, a first end 433, and a second end 434. A curved segment 460 connects end 334 to end 433. The path for the material passes through the first segment 330 from end 333 to end 334 and through the second segment 470 from end 433 to end 434.

In FIG. 10*a,* segment 330 has an opening 440 at end 334. Segment 470 has an opening 540 at end 433. The path exits opening 440 and enters opening 540. The structure shown allows the material to be treated or cooled before being heated in segment 470.

In FIG. 10*b,* the path passes through the first segment from end 333 to end 334, through the curved segment 460, and through the second segment 470 from the end 433 to end 434. The path passes around a roller 380 as it passes through the curved segment 460. The structure shown allows the material to be continuously heated. In either device, the path can follow a curved or straight shape so as to pass through a region that is off-peak.

While the foregoing description makes reference to particular illustrative embodiments, these examples should not be construed as limitations. For example, the description frequently refers to a planar material that is passed through a slotted waveguide. However, it will be evident to those skilled in the art that the disclosed invention can be used to heat a wide range of materials in a wide range of cavities. Thus, the present invention is not limited to the disclosed embodiments, but is to be accorded the widest scope consistent with the claims below.

What is claimed is:

1. A device for heating the edge of a material, the device comprising:

a segment having a first conductive surface and a second conductive surface, the segment having a first end and a second end, the segment comprising an opening for an edge of a material;

a source capable of generating an electromagnetic wave that propagates in a direction from the first end to the second end, the electromagnetic wave creating an electric field between the two conducting surfaces;

means for passing the edge of the material from the first end of the segment to the second end of the segment inside the segment and the middle of the material from the first end of the segment to the second end of the segment outside the segment;

a second segment having a first conductive surface, a second conductive surface, a first end, and a second end, the segment comprising an opening for a second edge of the material;

the means for passing configured to pass the first edge of the material from the first end of the first segment to the second end of the first segment inside the first segment, the second edge of the material from the first end of the second segment to the second end of the second segment inside the second segment, and the middle of the material from the first end of both segments to the second end of both segments outside both segments.

2. A device as described in claim 1, wherein the conductive surfaces are opposite sides of a rectangular waveguide.

3. A device as described in claim 2, wherein the electromagnetic wave is in $TE_{10}$ mode.

4. A device as described in claim 2, wherein the edges pass through a region that is a more off-peak region of the electric field at the first end than at the second end.

5. A device as described in claim 2, wherein the edges travel along a diagonal path from the first end to the second end.

6. A device as described in claim 5, wherein the angle of the diagonal path is adjusted according to the lossiness of the material to be heated.

7. A device as described in claim 2, wherein the edges pass through a more off-peak region to a less off-peak region to a more off-peak region.

8. A device as described in claim 1, the segment comprising small openings for vapor removal and/or pressurized air.

9. A device as described in claim 1, the device further comprising a smooth bend, the smooth bend connecting the source to at least one of the segments.

10. A device as described in claim 1, the device further comprising a E-plane bend, the E-plane bend connecting the source to at least one of the segments.

11. A device as described in claim 10, the opening through the E-plane bend.

12. A device as described in claim 1, the device further comprising:

a third segment, the third segment connected to the first segment by a curved segment;

a short, the short operable to create a standing wave in the first segment and the third segment, the standing wave comprising a plurality of peaks and valleys; and a movable surface, the movable surface operable to push and pull the plurality of peaks and valleys to achieve more uniform heating of the material.

13. A device as described in claim 1, the segment having a cutoff frequency, the source sweeping a frequency of the electromagnetic wave between the cutoff frequency and double the cutoff frequency.

14. A device as described in claim 1, the device further comprising:

a rectangular choke flange, the rectangular choke flange extending outward from an opening at the first end of the segment.

15. A device as described in claim 1, the device further comprising:

a third segment having a first conductive surface, a second conductive surface, a first end, and a second end; and a curved segment, the curved segment connecting the second end of the first segment to the first end of the third segment, the edge passing through the first segment from the first end of the first segment to the second end of the first segment and through the second segment from the first end of the second segment to the second end of the second segment.

16. A device as described in claim 15, the edge passing through a region that is more off-peak at the first end of the third segment than at the second end of the third segment.

17. A device as described in claim 15, the device further comprising a first opening at the second end of the first segment and a second opening at the first end of the third segment, the edge exiting the first opening and entering the second opening.

18. A device as described in claim 15, the edge passing through the first segment from the first end of the first segment to the second end of the first segment, through the curved segment, and through the third segment from the first end of the second segment to the second end of the second segment.

19. A device as described in claim 18, the device further comprising a roller, the edge passing around the roller as it passes through the curved segment.

20. A device for heating the edge of a material, the device comprising:

a segment having a first conductive surface and a second conductive surface, the segment having a first end and a second end, the segment comprising an opening for an edge of a material;

a source capable of generating an electromagnetic wave that propagates in a direction from the first end to the second end, the electromagnetic wave creating an electric field between the two conducting surfaces;

means for passing the edge of the material from the first end of the segment to the second end of the segment inside the segment and the middle of the material from the first end of the segment to the second end of the segment outside the segment;

the edge of the material passing through a region that is more off-peak at the first end of the segment than at the second end of the segment.

21. A device for heating the edge of a material, the device comprising:

a segment having a first conductive surface and a second conductive surface, the segment having a first end and a second end, the segment comprising an opening for an edge of a material;

a source capable of generating an electromagnetic wave that propagates in a direction from the first end to the second end, the electromagnetic wave creating an electric field between the two conducting surfaces;

means for passing the edge of the material from the first end of the segment to the second end of the segment inside the segment and the middle of the material from the first end of the segment to the second end of the segment outside the segment;

a second segment, the second segment connected to the first segment by a curved segment;

a short, the short operable to create a standing wave in the first segment and the second segment, the standing wave comprising a plurality of peaks and valleys; and a movable surface, the movable surface operable to push and pull the plurality of peaks and valleys to achieve more uniform heating of the edge of the material.

22. A device for heating the edge of a material, the device comprising:

a segment having a first conductive surface and a second conductive surface, the segment having a first end and a second end, the segment comprising an opening for an edge of a material;

a source capable of generating an electromagnetic wave that propagates in a direction from the first end to the second end, the electromagnetic wave creating an electric field between the two conducting surfaces;

means for passing the edge of the material from the first end of the segment to the second end of the segment inside the segment and the middle of the material from the first end of the segment to the second end of the segment outside the segment;

the segment having a cutoff frequency, the source sweeping a frequency of the electromagnetic wave between the cutoff frequency and double the cutoff frequency.

23. A device for heating the edge of a material, the device comprising;

a segment having a first conductive surface and a second conductive surface, the segment having a first end and a second end, the segment comprising an opening for an edge of a material;

a source capable of generating an electromagnetic wave that propagates in a direction from the first end to the second end, the electromagnetic wave creating an electric field between the two conducting surfaces;

means for passing the edge of the material from the first end of the segment to the second end of the segment inside the segment and the middle of the material from the first end of the segment to the second end of the segment outside the segment;

a second segment having a first conductive surface, a second conductive surface, a first end, and a second end; and a curved segment, the curved segment connecting the second end of the first segment to the first end of the second segment, the means for passing configured to pass the edge of the material from the first end of the first segment to the second end of the first segment inside the first segment and from the first end of the second segment to the second end of the second segment inside the second segment and the middle of the material from the first end of the first segment to the second end of the first segment outside the first segment and from the first end of the second segment to the second end of the second segment outside the second segment.

* * * * *